US007679632B2

(12) United States Patent
Iwasaki

(10) Patent No.: US 7,679,632 B2
(45) Date of Patent: Mar. 16, 2010

(54) THERMAL PRINTER AND METHOD OF CONTROLLING THE SAME

(75) Inventor: Fumiharu Iwasaki, Sunto-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 209 days.

(21) Appl. No.: 11/681,925

(22) Filed: Mar. 5, 2007

(65) Prior Publication Data

US 2007/0279477 A1 Dec. 6, 2007

(30) Foreign Application Priority Data

May 31, 2006 (JP) ..... 2006-151694
May 31, 2006 (JP) ..... 2006-152576

(51) Int. Cl.
*B41J 2/00* (2006.01)

(52) U.S. Cl. ..... 347/190

(58) Field of Classification Search ..... 347/211, 347/171, 218, 215, 190
See application file for complete search history.

(56) References Cited

U.S. PATENT DOCUMENTS

| | | | | |
|---|---|---|---|---|
| 6,118,469 | A | 9/2000 | Hosomi | |
| 6,759,366 | B2 | 7/2004 | Beckerdite et al. | |
| 6,784,906 | B2 | 8/2004 | Long et al. | |
| 2007/0211132 | A1* | 9/2007 | Lyons et al. | 347/190 |

FOREIGN PATENT DOCUMENTS

| | | |
|---|---|---|
| EP | 1321296 | 6/2003 |
| JP | 57-093486 | 6/1982 |
| JP | 58-008668 | 1/1983 |
| JP | 61-003765 | 1/1986 |
| JP | 63-137847 | 6/1988 |
| JP | 03-051149 | 3/1991 |
| JP | 06-024082 | 2/1994 |
| JP | 06-027153 | 4/1994 |
| JP | 09-233256 | 9/1997 |
| JP | 09-289561 | 11/1997 |
| JP | 10-076713 | 3/1998 |
| JP | 11-286147 | 10/1999 |
| JP | 2000-315275 | 11/2000 |
| JP | 2001-199095 | 7/2001 |
| JP | 2003-200641 | 7/2003 |
| JP | 2005-329572 | 12/2005 |

OTHER PUBLICATIONS

European Search Report for EP 07 10 9061 dated Sep. 27, 2007 corresponding to U.S. Appl. No. 11/681,925 filed on Mar. 5, 2007.
Japanese Office Action dated Apr. 1, 2008 corresponding to U.S. Appl. No. 11/681,925 filed on Mar. 5, 2007.
Japanese Office Action dated Apr. 16, 2008 corresponding to U.S. Appl. No. 11/681,925 filed on Mar. 5, 2007.
Japanese Office Action dated Aug. 8, 2008 corresponding to U.S. Appl. No. 11/681,925 filed on Mar. 5, 2007.

* cited by examiner

*Primary Examiner*—K. Feggins
(74) *Attorney, Agent, or Firm*—Turocy & Watson, LLP

(57) ABSTRACT

A first thermal head that comes into contact with a front surface of a thermal paper sheet, and a second thermal head that comes into contact with a rear surface of the thermal paper sheet are provided. Further, forward printing and backward printing of the first thermal head with respect to the front surface of the thermal paper sheet are selectively controlled. Furthermore, forward printing and backward printing of the thermal head with respect to the rear surface of the thermal paper sheet are selectively controlled.

8 Claims, 7 Drawing Sheets

576 bits (=16 bits X 36)

16 bits 16 bits

| Raster \ Bit | 15 | 14 | 13 | 12 | 11 | 10 | 9 | 8 | 7 | 6 | 5 | 4 | 3 | 2 | 1 | 0 | 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|---|---|---|---|---|---|---|---|---|---|---|---|---|---|---|---|---|
| 1 | 1 | 0 | 0 | 0 | 0 | 0 | 0 | 0 | 1 | 1 | 1 | 1 | 1 | 1 | 1 | 1 | 0 | 1 | 1 | 1 | 1 | 0 | 0 | 0 | 0 | | | | | | | |
| 2 | | | | | | | | | | | | | | | | | | | | | | | | | | | | | | | | |
| 3 | | | | | | | | | | | | | | | | | | | | | | | | | | | | | | | | |
| 4 | | | | | | | | | | | | | | | | | | | | | | | | | | | | | | | | |
| 5 | | | | | | | | | | | | | | | | | | | | | | | | | | | | | | | | |
| 6 | | | | | | | | | | | | | | | | | | | | | | | | | | | | | | | | |
| 19 | | | | | | | | | | | | | | | | | | | | | | | | | | | | | | | | |
| 20 | | | | | | | | | | | | | | | | | | | | | | | | | | | | | | | | |
| 21 | | | | | | | | | | | | | | | | | | | | | | | | | | | | | | | | |
| 22 | | | | | | | | | | | | | | | | | | | | | | | | | | | | | | | | |
| 23 | | | | | | | | | | | | | | | | | | | | | | | | | | | | | | | | |
| 24 | | | | | | | | | | | | | | | | | | | | | | | | | | 1 | 0 | 1 | 0 | 1 | 0 | 1 | 0 | 1 | 1 | 0 | 0 | 1 | 0 | 1 | 0 | 1 | 1 | 1 | 1 |

FIG. 9

THERMAL PRINTER AND METHOD OF CONTROLLING THE SAME

CROSS-REFERENCE TO RELATED APPLICATIONS

This application is based upon and claims the benefit of priority from prior Japanese Patent Applications No. 2006-151694, filed May 31, 2006; and No. 2006-152576, filed May 31, 2006, the entire contents of both of which are incorporated herein by reference.

BACKGROUND OF THE INVENTION

1. Field of the Invention

The present invention relates to a thermal printer that uses a thermal paper sheet having heat-sensitive layers on both surfaces thereof, and a method of controlling the same.

2. Description of the Related Art

A thermal paper sheet used in a thermal printer has a heat-sensitive layer on one surface thereof. In accordance with this structure, a thermal printer prints printing data input from the outside on one surface of a thermal paper sheet by using a single thermal head. The printed thermal paper sheet is cut by a cutter and provided to a user.

When an amount of printing data input from the outside is large, a thermal paper sheet on which the data is to be printed becomes long and hence it is difficult to handle by a user.

On the other hand, a thermal paper sheet having heat-sensitive layers on both surfaces thereof has been recently developed. In order to print data on both surfaces of the thermal paper sheet, there is required processing of, e.g., feeding a paper sheet to an image forming portion of a photosensitive drum or a development unit to form an image on a first surface of the paper sheet, returning the paper sheet having the image formed thereon to the image forming portion while reversing the paper sheet, and forming an image of a second surface of the paper sheet by the image forming portion, as in double-side copying in a copying machine (see, e.g., Jpn. Pat. Appln. KOKAI Publication No. 233256-1997 and Jpn. Pat. Appln. KOKAI Publication No. 24082-1994).

However, the processing similar to a copying machine takes time, and it cannot be applied to a thermal printer used for issuing a sales receipt to a customer at, e.g., a store.

BRIEF SUMMARY OF THE INVENTION

It is an object of the present invention to provide a thermal printer that can rapidly print an image corresponding to printing data on both surfaces of a thermal paper sheet in both forward and backward directions.

According to the present invention, there is provided a thermal printer, comprising:

a thermal paper sheet which has heat-sensitive layers on both surfaces thereof, and is subjected to paper feeding;

a first thermal head which comes into contact with a first surface of the thermal paper sheet;

a second thermal head which comes into contact with a second surface of the thermal paper sheet; and a control section which selectively controls forward printing and backward printing of the first thermal head with respect to the first surface of the thermal paper sheet and also selectively controls forward printing and backward printing of the second thermal head with respect to the second surface of the thermal paper sheet.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 9 is a view showing storage regions of a first and a second image memories in the second embodiment;

DETAILED DESCRIPTION OF THE INVENTION

[1] First Embodiment

Figure 1:
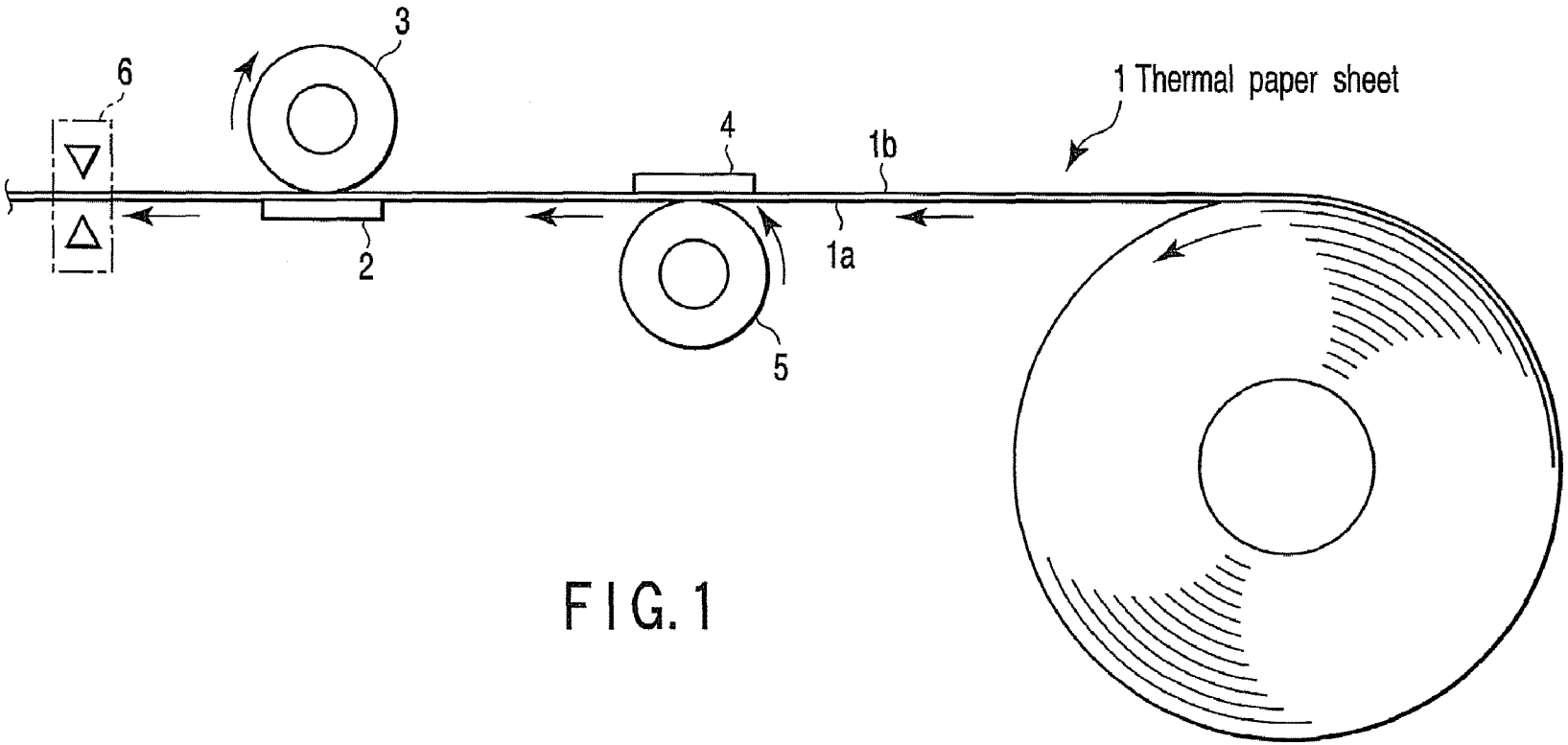
FIG. 1 is a view showing a structure of a primary part in each embodiment.

A first embodiment according to the present invention will now be described hereinafter with reference to the accompanying drawings. First, FIG. 1 shows a structure of a primary part.

Reference numeral 1 denotes a thermal paper sheet. The thermal paper sheet 1 has heat-sensitive layers on both surfaces thereof, i.e., a first surface (which will be referred to as a front surface) 1*a* and a second surface (which will be referred to as a rear surface) 1*b*, respectively. The thermal paper sheet 1 is rolled up in such a manner that the front surface 1*a* becomes an inner side, and fed in a direction indicated by an arrow in the drawing by a later-described paper feed mechanism 22. The heat-sensitive layer is made up of a material that is colored into, e.g., black or red when heated to a predetermined temperature or above.

A first thermal head 2 that comes into contact with the front surface 1*a* of the thermal paper sheet 1 and a second thermal head 4 that comes into contact with the rear surface 1*b* of the same are provided along a paper feed direction of this thermal paper sheet 1. The first thermal head 2 has many heating elements arranged in a direction perpendicular to the paper feed direction of the thermal paper sheet 1, and prints an image corresponding to input data on the front surface 1*a* of the thermal paper sheet 1. The second thermal head 4 has many heating elements arranged in a direction perpendicular to the paper feed direction of the thermal paper sheet 1, and prints an image corresponding to input data on the rear surface 1*b* of the thermal paper sheet 1. These thermal heads 2 and 4 are arranged at positions separated from each other along the paper feed direction of the thermal paper sheet 1. The first thermal head 2 is arranged on a downstream side of the second thermal head 4 in the paper feed direction.

Further, a first platen roller 3 is arranged at a position facing the first thermal head 2, with the thermal paper sheet 1 being interposed therebetween, and a second platen roller 5 is arranged at a position facing the second thermal head 4, with the thermal paper sheet 1 being interposed therebetween. Furthermore, a cutter 6 that cuts the thermal paper sheet 1 on a rear side of a printing region is arranged on a downstream side of the first thermal head 2 in the paper feed direction.

Figure 2:
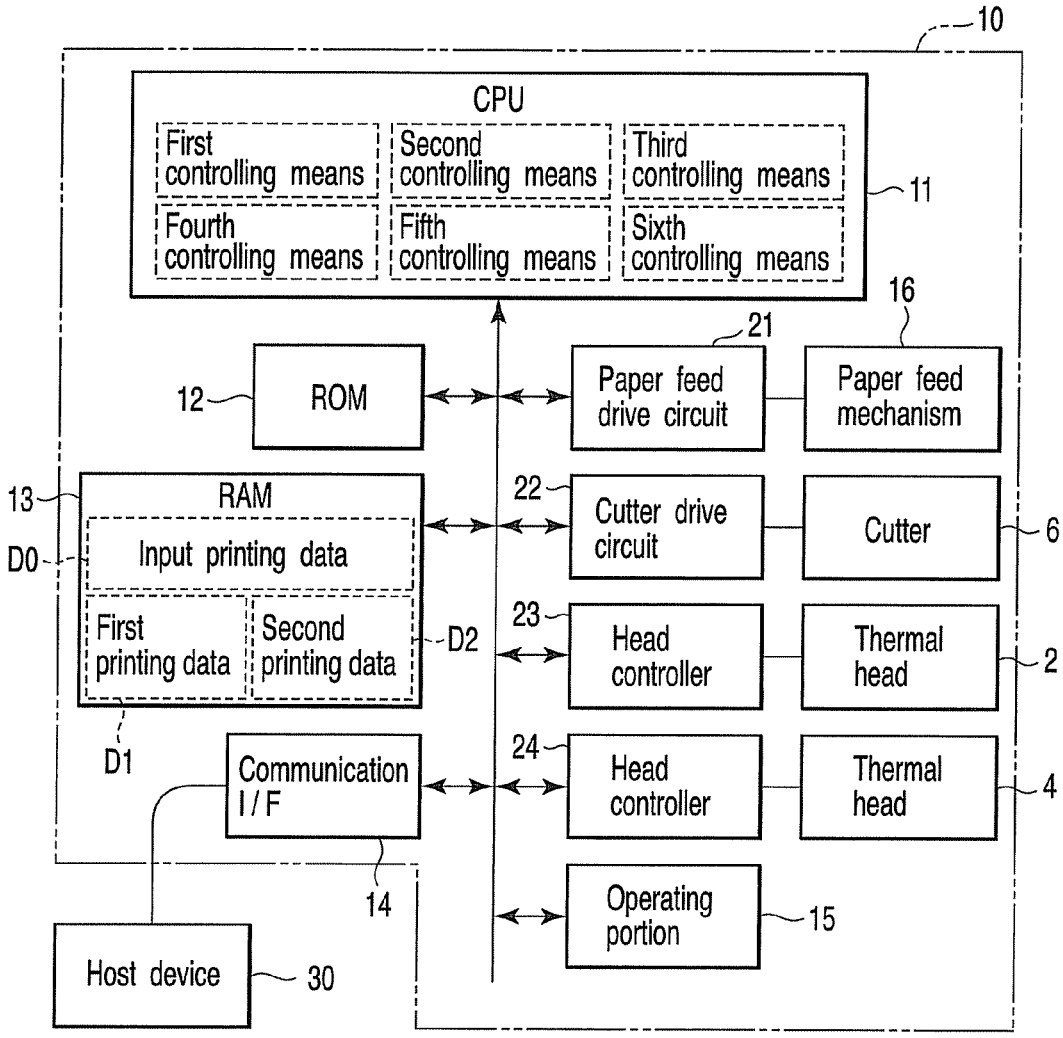
FIG. 2 is a block diagram of a control circuit in a first embodiment.

FIG. 2 shows a control circuit of a thermal printer main body 10 including the structure depicted in FIG. 1.

To a CPU 11 as a control section are connected an ROM 12 that stores a control program, an RAM 13 that storage data, a communication interface 14 that performs data transmission/reception with respect to a host device 30, an operating section 15 that sets operating conditions, a paper feed drive circuit 21 that drives a paper feed mechanism 16 for the thermal paper sheet 1, a cutter drive circuit 22 that drives the cutter 6, a first head controller 23 that drives and controls the first thermal head 2 in accordance with later-described first printing data D1, a second head controller 24 that drives and controls the second thermal head 4 in accordance with later-described second printing data D2, and others.

Figure 3:
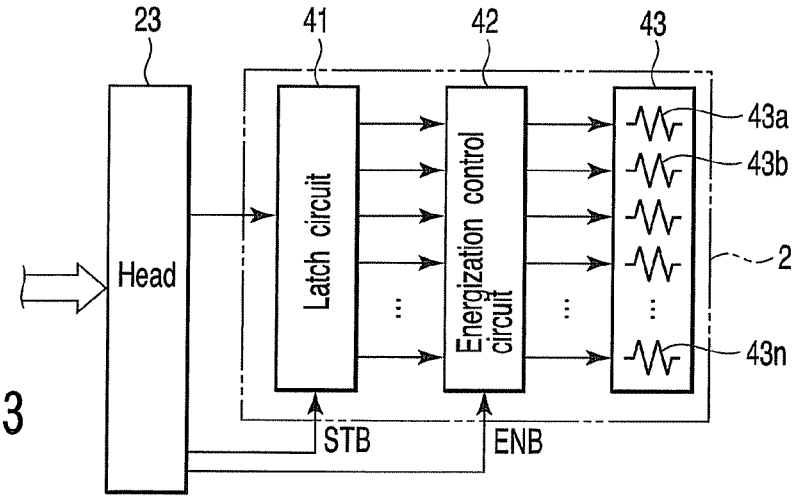
FIG. 3 is a block diagram showing a specific structure of a thermal head in each embodiment.

As shown in FIG. 3, the first thermal head 2 is constituted of a latch circuit 41, an energization control circuit 42, and an edge head 43. The edge head 43 has many heat-transfer heating elements 43*a*, 43*b*, . . . 43*n* that are linearly arranged. The latch circuit 41 latches data serially read from a first image memory 25 in accordance with a strobe signal STB supplied from the head controller 23. The energization control circuit 42 controls energization with respect to the heating elements 43*a*, 43*b*, . . . 43*n* of the edge head 43 in accordance with data in the latch circuit 41 at a timing at which an enable signal ENB supplied from the head drive circuit 23 becomes active. The second thermal head 4 also has the same structure as that of the first thermal head 2.

On the other hand, the CPU 11 selectively controls forward printing and backward printing of the first thermal head 2 with respect to the front surface 1*a* of the thermal paper sheet 1, and also selectively controls forward printing and backward printing of the second thermal head 4 with respect to the rear surface 1*b* of the thermal paper sheet 1. The CPU 11 has the following means (1) to (6) as primary functions.

(1) First controlling means for dividing printing data D0 input from the external host device 30 into the first printing data D1 and the second printing data D2. The divided printing data D1 and D2 are stored in the RAM 13 together with the printing data D0.

(2) Second controlling means for serially reading the first printing data D1 in the RAM 13 in a direction from a most significant bit to a least significant bit and inputting the read data to the first thermal head 2 via the first head controller 23 at the time of forward printing with respect to the front surface 1*a* of the thermal paper sheet 1.

(3) Third controlling means for serially reading the first printing data D1 in the RAM 13 in a direction from the least significant bit to the most significant bit and inputting the read data to the first thermal head 2 via the first head controller 23 at the time of backward printing with respect to the front surface 1*a* of the thermal paper sheet 1.

(4) Fourth controlling means for serially reading the second printing data D2 in the RAM 13 in the direction from the most significant bit to the least significant bit and inputting the read data to the second thermal head 4 via the second head controller 24 at the time of forward printing with respect to the rear surface 1*b* of the thermal paper sheet 1.

(5) Fifth controlling means for serially reading the second printing data D2 in the RAM 13 in the direction from the least significant bit to the most significant bit and inputting the read data to the second thermal head 4 via the second head controller 24 at the time of backward printing with respect to the rear surface 1*b* of the thermal paper sheet 1.

(6) Sixth controlling means for first starting driving of the second thermal head 4 while feeding the thermal paper sheet 1, and then starting driving of the first thermal head 2 when a printing start position based on the first driving corresponds to the first thermal head 2.

A function will now be explained.

When the printing data D0 is input to the thermal printer main body 10 from the external host device 30, the printing data D0 is stored in the RAM 13. In accordance with this storage, the printing data D0 is divided into the first printing data D1 and the second printing data D2 based on preset conditions. The divided first printing data D1 and second printing data D2 are stored in the RAM 13 together with the printing data D0.

After this division, feeding of the thermal paper sheet 1 is started, and driving of the second thermal head 4 is first commenced, thereby executing printing on the rear surface 1*b* of the thermal paper sheet 1. When feeding of the thermal paper sheet 1 advances and a printing start position on the rear surface 1*b* side based on driving of the second thermal head 4 enters a state corresponding to the first thermal head 2, driving of the first thermal head 2 is started, thus executing printing on the front surface 1*a* of the thermal paper sheet 1.

In this double-side printing, if a first operation mode is set by the operating portion 15 or when the first operation mode is instructed from the host device 30, the first printing data D1 in the RAM 13 is serially read in the direction from the most significant bit (MSB) to the least significant bit (LSB) to be input to the first thermal head 2 via the first head controller 23.

Likewise, the second printing data D2 in the RAM 13 is serially read in the direction from the most significant bit (MSB) to the least significant bit (LSB) to be input to the second thermal head 4 via the second head controller 24.

Figure 4:
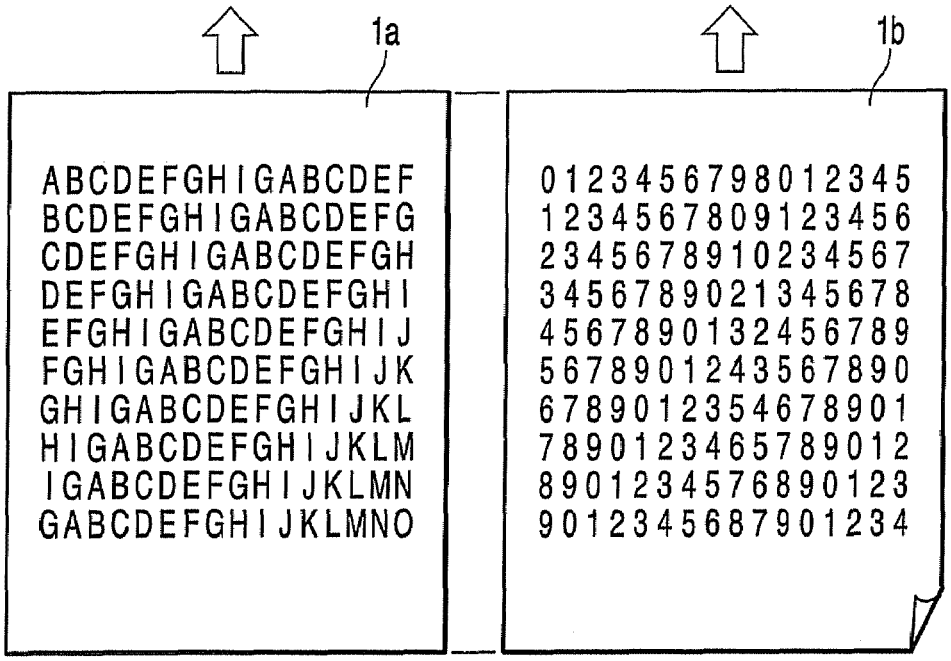
FIG. 4 is a view showing a printing result in a first operation mode in each embodiment.

In this manner, as shown in FIG. 4, an image corresponding to the first printing data D1 is printed on the front surface 1*a* of the thermal paper sheet 1 in the forward direction. Furthermore, an image corresponding to the second printing data D2 is printed on the rear surface 1*b* of the thermal paper sheet 1 in the forward direction.

The printed thermal paper sheet 1 is cut by the cutter 6 to be provided as, e.g., a sales receipt to a customer.

If a second operation mode is set by the operating portion 15 or when the second operation mode is instructed from the host device 30, the first printing data D1 in a time chart 13 is serially read in the direction from the least significant bit (LSB) to the most significant bit (MSB) to be input to the first thermal head 2 via the first head controller 23.

Moreover, the second printing data D2 in the RAM 13 is serially read in the direction from the most significant bit (MSB) to the least significant bit (LSB) to be input to the second thermal head 4 via the second head controller 24.

Figure 5:
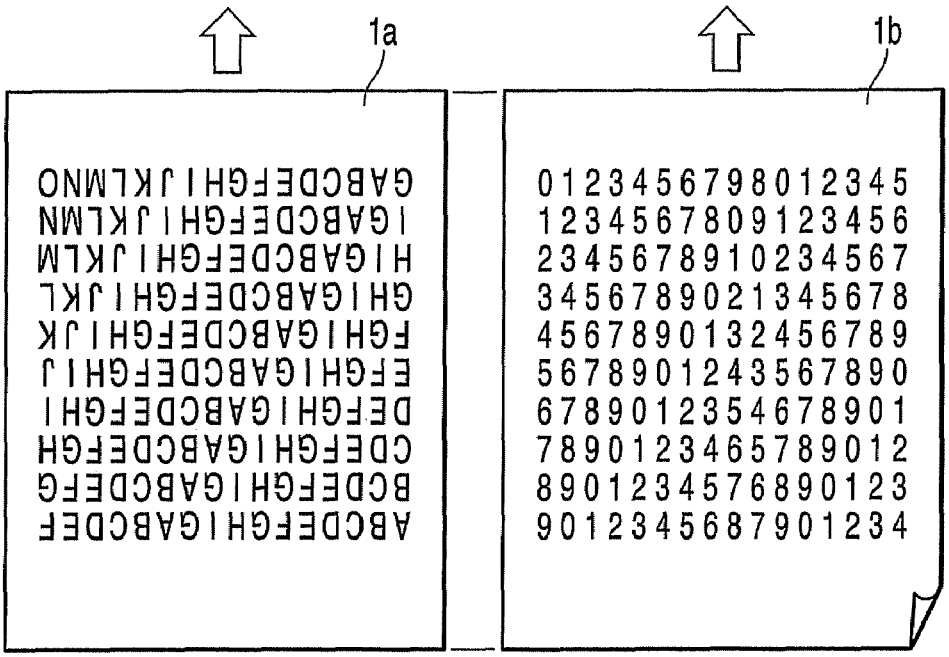
FIG. 5 is a view showing a printing result in a second operation mode in each embodiment.

In this manner, as shown in FIG. 5, an image corresponding to the first printing data D1 is printed on the front surface 1*a* of the thermal paper sheet 1 in the backward direction. Additionally, an image corresponding to the second printing data D2 is printed on the rear surface 1*b* of the thermal paper sheet 1 in the forward direction.

If a third operation mode is set by the operating portion 15 or when the third operation mode is instructed from the host device 30, the first printing data D1 in the RAM 13 is serially read in the direction from the most significant bit (MSB) to the least significant bit (LSB) to be input to the first thermal head 2 via the first head controller 23.

Further, the second printing data D2 in the RAM 13 is serially read in the direction from the least significant bit (LSB) to the most significant bit (MSB) to be input to the second thermal head 4 via the second head controller 24.

Figure 6:
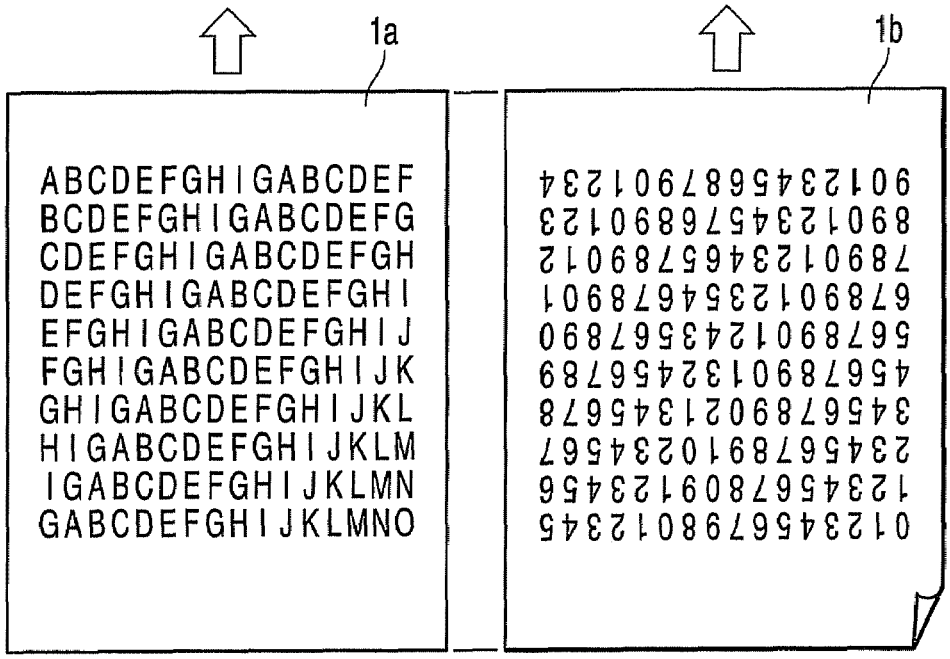
FIG. 6 is a view showing a printing result in a third operation mode in each embodiment.

In this manner, as shown in FIG. 6, an image corresponding to the first printing data D1 is printed on the front surface 1*a* of the thermal paper sheet 1 in the forward direction. Furthermore, an image corresponding to the second printing data D2 is printed on the rear surface 1*b* of the thermal paper sheet 1 in the backward direction.

If a fourth operation mode is set by the operating portion 15 or when the fourth operation mode is instructed from the host device 30, the first printing data D1 in the RAM 13 is serially read in the direction from the least significant bit (LSB) to the most significant bit (MSB) to be input to the first thermal head 2 via the first head controller 23.

Likewise, the second printing data D2 in the RAM 13 is serially read in the direction from the least significant bit (LSB) to the most significant bit (MSB) to be input to the second thermal head 4 via the second head controller 24.

Figure 7:
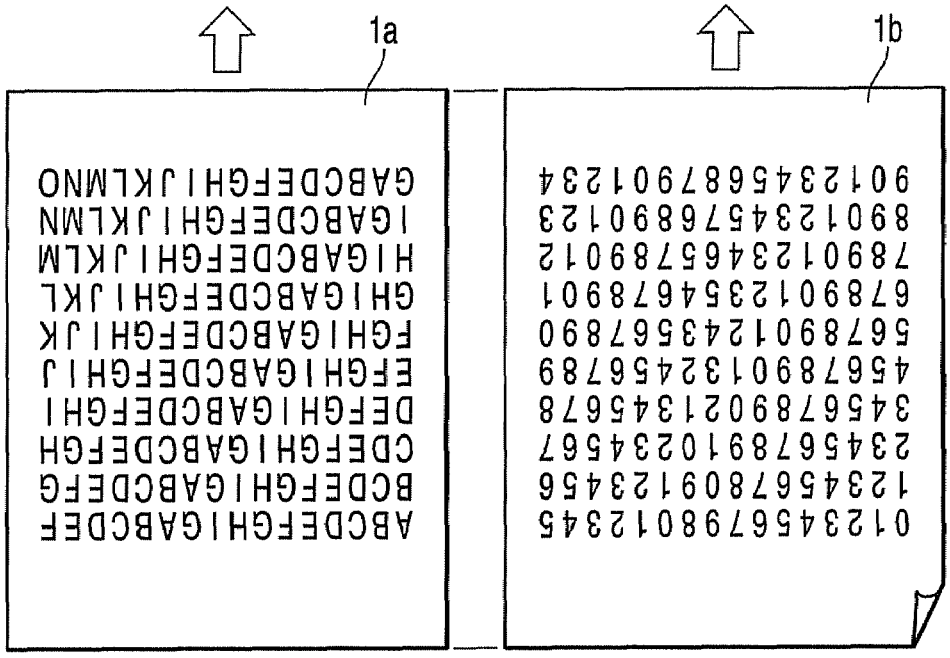
FIG. 7 is a view showing a printing result in a fourth operation mode in each embodiment.

In this manner, as shown in FIG. 7, an image corresponding to the first printing data D1 is printed on the front surface 1*a* of the thermal paper sheet 1 in the backward direction. Moreover, an image corresponding to the second printing data D2 is printed on the rear surface 1*b* of the thermal paper sheet 1 in the backward direction.

As explained above, the thermal paper sheet 1 having the heat-sensitive layers on both surfaces thereof is prepared, and the first thermal head 2 that comes into contact with the front surface 1*a* of the thermal paper sheet 1 and the second thermal head 4 that comes into contact with the rear surface 1*b* of the same are provided. The printing data D0 input from the host device 30 is divided into the first printing data D1 and the second printing data D2, and the thermal heads 2 and 4 are driven and controlled in accordance with the printing data D1 and D2. As a result, the printing data D0 can be divided and rapidly printed on the front surface 1*a* and the rear surface 1*b* of the thermal paper sheet 1.

Therefore, even if an amount of the printing data D0 is large, a length of the thermal paper sheet 1 on which data is to be printed can be reduced. When the thermal paper sheet 1 is used as, e.g., a sales receipt at a store, many pieces of commodity purchase data can be printed on the short receipt, and hence the thermal paper sheet 1 is easy to handle for users. This also saves thermal paper.

Additionally, since the reading directions of the first printing data D1 and the second printing data D2 can be appropriately switched, images corresponding to the printing data D1 and D2 can be printed on both surfaces of the thermal paper sheet 1 in both the forward and the backward directions. Adopting the forward printing and the backward printing allows the thermal paper sheet 1 to be used in various applications.

When a conventional single-side printing type thermal printer is connected with the host device 30, simply replacing the conventional thermal printer with the thermal printer main body 10 according to this embodiment easily allows the processing of dividing the printing data D0 and the double-side printing processing to be executed, without changing hardware and software on the host device 30 side. Since only the thermal printer is replaced, the functions can be enhanced while suppressing an increase in a cost on a user side to the minimum level.

[2] Second Embodiment

Figure 8:
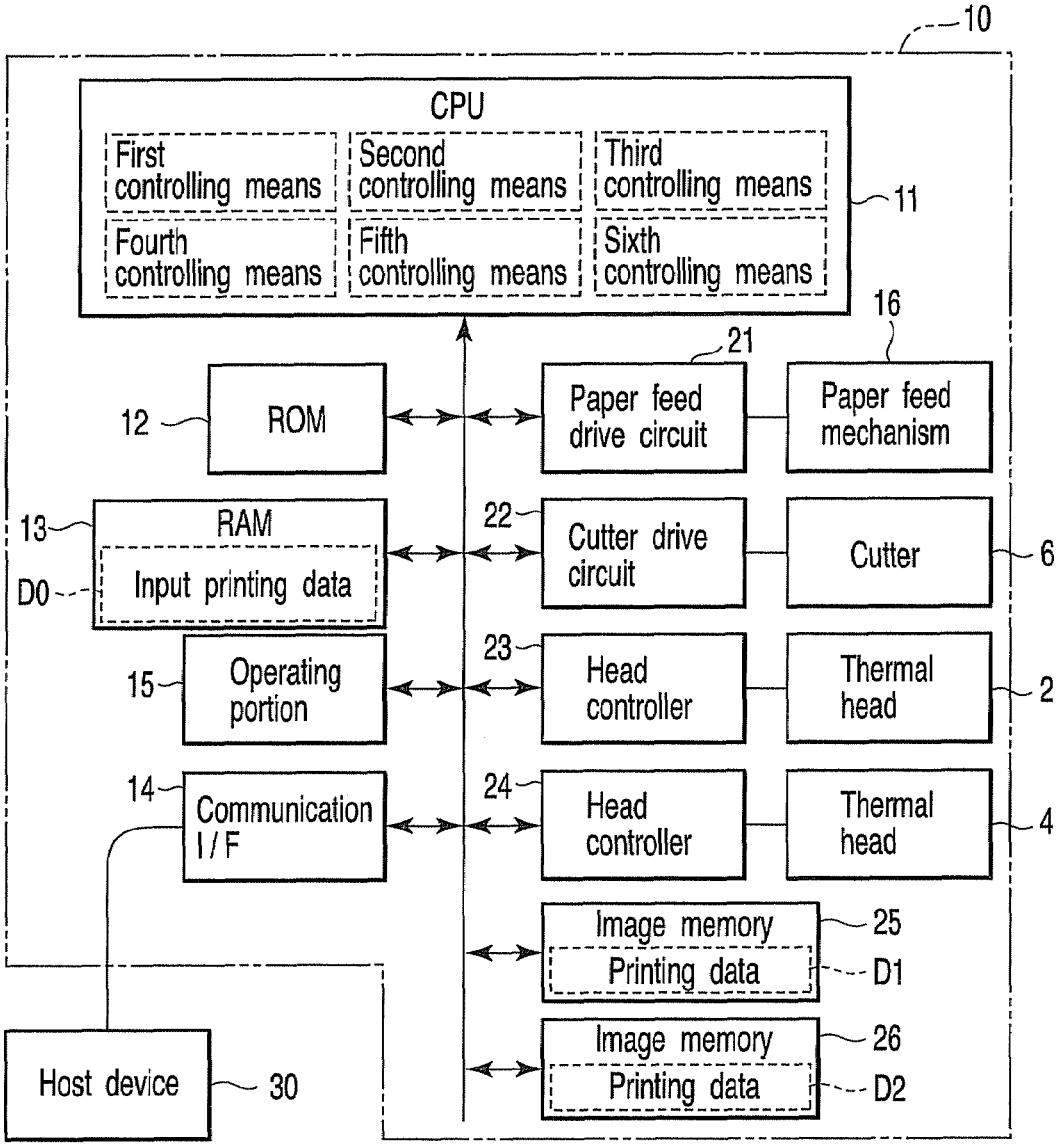
FIG. 8 is a block diagram of a control circuit in a second embodiment.

A second embodiment according to the present invention will now be described with reference to the accompanying drawings. The basic structure is the same as that depicted in FIG. 1, thereby omitting an explanation thereof. FIG. 8 shows a control circuit of a thermal printer main body 10 including the structure depicted in FIG. 1.

To a CPU 11 as a control section are connected to a ROM 12 that stores a control program, a RAM 13 that stores data, a communication interface 14 that performs data transmission/reception with respect to a host device 30, an operating portion 15 that sets operating conditions, a paper feed drive circuit 21 that drives a paper feed mechanism 16 of a thermal paper sheet 1, a cutter drive circuit 22 that drives a cutter 6, a first head controller 23 that drives and controls a first thermal head 2 in accordance with later-described first printing data D1, a second head controller 24 that drives and controls a second thermal head 4 in accordance with later-described second printing data D2, a first image memory 25 that stores the later-described first printing data D1, a second image memory 26 that stores the later-described second printing data D2, and others.

Figure 10:
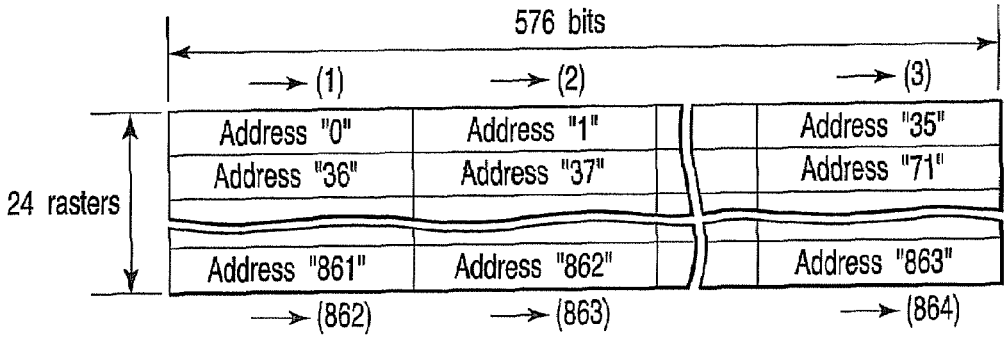
FIG. 10 is a view showing a data reading direction from each image memory at the time of forward printing in the second embodiment.

As shown in FIG. 9, the first image memory 25 has 24 raster storage regions, each of which has 36 16-bit storage regions aligned in one raster. As shown in FIG. 10, addresses "0" to "863" are set in accordance with each 16-bit storage region. The second image memory 26 has the same structure.

The structure of each of the first thermal head 2 and the second thermal head 4 is the same as that depicted in FIG. 3, thereby omitting an explanation thereof.

On the other hand, the CPU 11 selectively controls forward printing and backward printing of the first thermal head 2 with respect to a front surface 1*a* of the thermal paper sheet 1, and also selectively controls forward printing and backward printing of the second thermal head 4 with respect to a rear surface 1*b* of the thermal paper sheet 1. The CPU 11 has the following means (11) to (16) as primary functions.

(11) First controlling means for dividing printing data D0 input from the external host device 30 into the first printing data D1 and the second printing data D2, and storing the first printing data D1 in the first image memory 25 while storing the second printing data D2 in the second image memory 26.

(12) Second controlling means for serially reading the first printing data D1 in the first image memory 25 in a direction from a most significant bit to a least significant bit in accordance with each raster and inputting the read data to the first thermal head 2 via the first head controller 23 at the time of forward printing with respect to the front surface 1*a* of the thermal paper sheet 1.

(13) A third controlling means for serially reading the first printing data D1 in the first image memory 25 in a direction from the least significant bit to the most significant bit in accordance with each raster and inputting the read data to the first thermal head 2 via the first head controller 23 at the time of backward printing with respect to the front surface 1*a* of the thermal paper sheet 1.

(14) Fourth controlling means for serially reading the second printing data D2 in the second image memory 26 in the direction from the most significant bit to the least significant bit in accordance with each raster and inputting the read data to the second thermal head 4 via the second head controller at the time of forward printing with respect to the rear surface 1*b* of the thermal paper sheet 1.

(15) Fifth controlling means for serially reading the second printing data D2 in the second image memory 26 in the direction from the least significant bit to the most significant bit in accordance with each raster and inputting the read data to the second thermal head 4 via the second head controller 24 at the time of backward printing with respect to the rear surface 1*b* of the thermal paper sheet 1.

(16) Sixth controlling means for first starting driving of the second thermal head 4 while feeding the thermal paper sheet 1, and then starting driving of the first thermal head 2 when a printing start position based on first driving corresponds to the first thermal head 2.

A function will now be explained.

When the printing data D0 is input to the thermal printer main body 10 from the external host device 30, the printing data D0 is stored in the RAM 13. In accordance with this storage, the printing data D0 is divided into the first printing data D1 and the second printing data D2 based on preset conditions. The divided first printing data D1 is stored in the first image memory 25, and the second printing data D2 is stored in the second image memory 26.

(a) First Operation Mode

After the division, feeding of the thermal paper sheet 1 is started, and driving of the second thermal head 4 is first commenced, thereby executing printing on the rear surface 1*b* of the thermal paper sheet 1. When feeding of the thermal paper sheet 1 advances and a printing start position on the rear surface 1*b* side based on driving of the second thermal head 4 enters a state corresponding to the first thermal head 2, driving of the first thermal head 2 is started, thus executing printing on the front surface 1*a* of the thermal paper sheet 1.

In this double-side printing, if a first operation mode is set by the operating portion 15 or when the first operation mode is instructed from the host device 30, as shown in FIGS. 5 and 6, the first printing data D1 in the first image memory 25 is serially read in a direction of a most significant bit (MSB) "15" to a least significant bit (LSB) "0" and in a direction from a minimum address "0" to a maximum address "863" in accordance with each raster to be input to the first thermal head 2 via the first head controller 23.

Likewise, the second printing data D2 in the second image memory 26 is serially read in a direction from the most significant bit (MSB) "15" to the least significant bit (LSB) "0" and in a direction from the minimum address "0" to the maximum address "863" in accordance with each raster to be input to the second thermal head 4 via the second head controller 24.

In this manner, as shown in FIG. 4, an image corresponding to the first printing data D1 is printed on the front surface 1*a* of the thermal paper sheet 1 in the forward direction. Furthermore, an image corresponding to the second printing data D2 is printed on the rear surface 1*b* of the thermal paper sheet 1 in the forward direction.

The printed thermal paper sheet 1 is cut by a cutter 6 to be provided as, e.g., a sales receipt to a customer.

(b) Second Operation Mode

Figure 12:
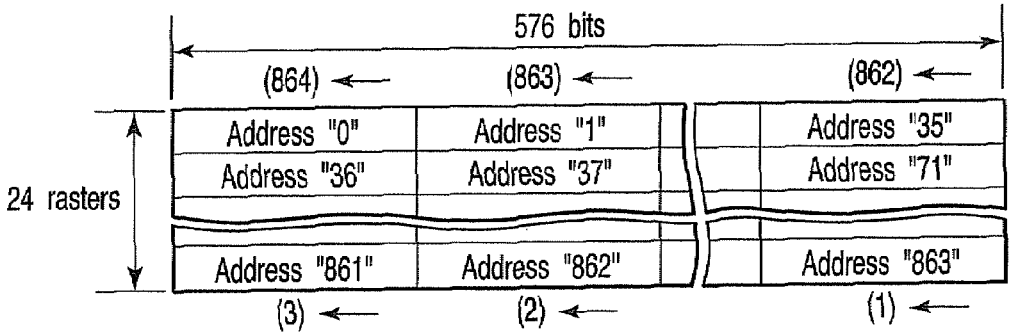
FIG. 12 is a view showing a data reading direction from each image memory at the time of backward printing in the second embodiment.
Figure 13:
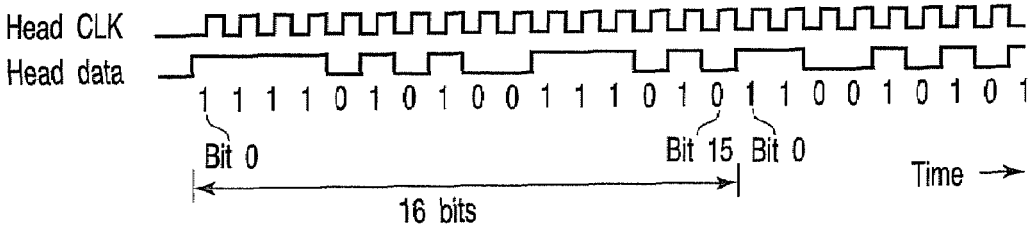
FIG. 13 is a time chart showing a data reading direction from each image memory at the time of backward printing in the second embodiment.

If a second operation mode is set by the operating portion 15 or when the second operation mode is instructed from the host device 30, as shown in FIGS. 12 and 13, the first printing data D1 in the first image memory 25 is serially read in the direction from the least significant bit (LSB) "0" to the most significant bit (MSB) "15" and in the direction from the maximum address "863" to the minimum address "0" in accordance with each raster to be input to the first thermal head 2 via the first head controller 23.

Figure 11:
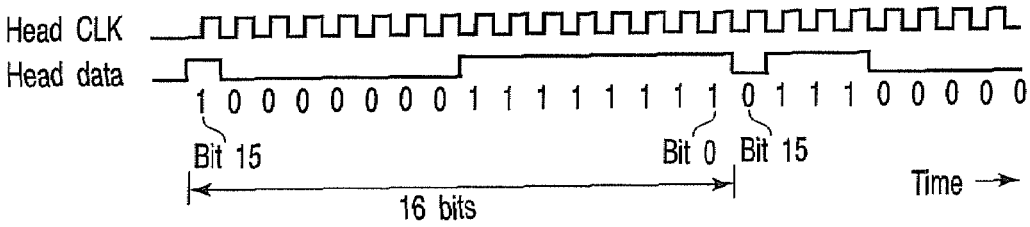
FIG. 11 is a time chart showing a data reading direction from each image memory at the time of forward printing in the second embodiment.

Moreover, as shown in FIGS. 10 and 11, the second printing data D2 in the second image memory 26 is serially read in the direction from the most significant bit (MSB) "15" to the least significant bit (LSB) "0" and in the direction from the minimum address "0" to the maximum address "863" in accordance with each raster to be input to the second thermal head 4 via the second head controller 24.

In this manner, as shown in FIG. 5, an image corresponding to the first printing data D1 is printed on the front surface 1*a* of the thermal paper sheet 1 in the backward direction. An image corresponding to the second printing data D2 is printed on the rear surface 1*b* of the thermal paper sheet 1 in the forward direction.

(c) Third Operation Mode

If a third operation mode is set by the operating portion 15 or when the third operation mode is instructed from the host device 30, as shown in FIGS. 10 and 11, the first printing data D1 in the first image memory 25 is serially read in the direction from the most significant bit (MSB) "15" to the least significant bit (LSB) "0" and in the direction from the minimum address "0" to the maximum address "863" in accordance with each raster to be input to the first thermal head 2 via the first head controller 23.

Further, as shown in FIGS. 12 and 13, the second printing data D2 in the second image memory 26 is serially read in the direction from the least significant bit (LSB) "0" to the most significant bit (MSB) "15" and in the direction from the maximum address "863" to the minimum address "0" in accordance with each raster to be input to the second thermal head 4 via the second head controller 24.

In this manner, as shown in FIG. 6, an image corresponding to the first printing data D1 is printed on the front surface 1*a* of the thermal paper sheet 1 in the forward direction. Furthermore, an image corresponding to the second printing data D2 is printed on the rear surface 1*b* of the thermal paper sheet 1 in the backward direction.

(d) Fourth Operation Mode

If a fourth operation mode is set by the operating portion 15 or when the fourth operation mode is instructed from the host device 30, as shown in FIGS. 12 and 13, the first printing data D1 in the first image memory 25 is serially read in the direction from the least significant bit (LSB) "0" to the most significant bit (MSB) "15" and in the direction from the maximum address "863" to the minimum address "0" to be input to the first thermal head 2 via the first head controller 23.

Likewise, as shown in FIGS. 12 and 13, the second printing data D2 in the second image memory 26 is serially read in the direction from the least significant bit (LSB) "0" to the most significant bit (MSB) "15" and in the direction from the maximum address "863" to the minimum address "0" in accordance with each raster to be input to the second thermal head 4 via the second head controller 24.

In this manner, as shown in FIG. 7, an image corresponding to the first printing data D1 is printed on the front surface 1*a* of the thermal paper sheet 1 in the backward direction. Furthermore, an image corresponding to the second printing data D2 is printed on the rear surface 1*b* of the thermal paper sheet 1 in the backward direction.

As explained above, the thermal paper sheet 1 having the heat-sensitive layers on both surfaces thereof is prepared, and the first thermal head 2 that comes into contact with the front surface 1*a* of the thermal paper sheet 1 and the second thermal head 4 that comes into contact with the rear surface 1*b* of the same are provided. The printing data D0 input from the host device 30 is divided into the first printing data D1 and the second printing data D2, and the thermal heads 2 and 4 are driven and controlled in accordance with the printing data D1 and D2. As a result, the printing data D0 can be divided and rapidly printed on the front surface 1*a* and the rear surface 1*b* of the thermal paper sheet 1.

Therefore, even if an amount of the printing data D0 is large, a length of the thermal paper sheet 1 on which data is to be printed can be reduced. When the thermal paper sheet 1 is used as, e.g., a sales receipt at a store, many pieces of commodity purchase data can be printed on the short receipt, and hence the thermal paper sheet 1 is easy to handle for users. This also saves thermal paper.

Moreover, the first printing data D1 and the second printing data D2 are stored in the first image memory 25 and the second image memory 26, and the reading directions of the stored printing data D1 and D2 can be appropriately switched. As a result, images corresponding to the printing data D1 and D2 can be printed on both surfaces of the thermal paper sheet 1 in both the forward direction and the backward direction. Adopting the forward printing and the backward printing allows the thermal paper sheet 1 to be used in various applications.

When a single-side printing type thermal printer is connected with the host device 30, simply replacing this thermal printer with the thermal printer main body 10 according to this embodiment easily allows the processing of dividing the printing data D0 and the double-side printing processing to be executed without changing hardware and software on the host device 30 side. Since only the thermal printer is replaced, the functions can be enhanced while suppressing an increase in a cost on a user side to the minimum level.

Further, the embodiments are not limited to a thermal printer using the thermal paper sheet 1 having the front surface and the rear surface on which the heat-sensitive layer is formed respectively. The embodiments of the present invention can also be applied to a thermal printer adopting a mechanism for feeding an ink ribbon between the thermal heads 2 and 4 and paper in order for the printer to accept a regular paper sheet and the like.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A thermal printer, comprising:

a thermal paper sheet which has heat-sensitive layers on both surfaces thereof, and is subjected to paper feeding;

a first thermal head which comes into contact with a first surface of the thermal paper sheet;

a second thermal head which comes into contact with a second surface of the thermal paper sheet; and a control section which selectively controls forward printing and backward printing of the first thermal head with respect to the first surface of the thermal paper sheet and also selectively controls forward printing and backward printing of the second thermal head with respect to the second surface of the thermal paper sheet, wherein the first thermal head prints an image corresponding to input printing data on the first surface of the thermal paper sheet, the second thermal head prints an image corresponding to input printing data on the second surface of the thermal paper sheet, and the control section has:

first controlling means for dividing printing data formed of a plurality of bits input from the outside into first printing data and second printing data;

second controlling means for serially reading the first printing data in a direction from a most significant bit to a least significant bit and inputting the read data to the first thermal head at the time of forward printing with respect to the first surface of the thermal paper sheet;

third controlling means for serially reading the first printing data in a direction from the least significant bit to the most significant bit and inputting the read data to the first thermal head at the time of backward printing with respect to the first surface of the thermal paper sheet;

fourth controlling means for serially reading the second printing data in the direction from the most significant bit to the least significant bit and inputting the read data to the second thermal head at the time of forward printing with respect to the second surface of the thermal paper sheet; and fifth controlling means for serially reading the second printing data in the direction from the least significant bit to the most significant bit and inputting the read data to the second thermal head at the time of backward printing with respect to the second surface of the thermal paper sheet.

2. The thermal printer according to claim 1, wherein each of the thermal heads has a plurality of heating elements that are linearly arranged along a direction perpendicular to a paper feed direction of the thermal paper sheet.

3. A method of controlling a thermal printer comprising: a thermal paper sheet which has heat-sensitive layers on both surfaces thereof, and is subjected to paper feeding; a first thermal head which prints an image corresponding to input printing data on a first surface of the thermal paper sheet; and a second thermal head which prints an image corresponding to input printing data on a second surface of the thermal paper sheet, the method comprising:

dividing printing data formed of a plurality of bits input from the outside into first printing data and second printing data;

serially reading the first printing data in a direction from a most significant bit to a least significant bit and inputting the read data to the first thermal head at the time of forward printing with respect to the first surface of the thermal paper sheet;

serially reading the first printing data in a direction from the least significant bit to the most significant bit and inputting the read data to the first thermal head at the time of backward printing with respect to the first surface of the thermal paper sheet;

serially reading the second printing data in the direction from the most significant bit to the least significant bit and inputting the read data to the second thermal head at the time of forward printing with respect to the second surface of the thermal paper sheet; and serially reading the second printing data in the direction from the least significant bit to the most significant bit and inputting the read data to the second thermal head at the time of backward printing with respect to the second surface of the thermal paper sheet.

4. A thermal printer, comprising:

a thermal paper sheet which has heat-sensitive layers on both surfaces thereof, and is subjected to paper feeding;

a first thermal head which comes into contact with a first surface of the thermal paper sheet;

a second thermal head which comes into contact with a second surface of the thermal paper sheet; and a control section which selectively controls forward printing and backward printing of the first thermal head with respect to the first surface of the thermal paper sheet and also selectively controls forward printing and backward printing of the second thermal head with respect to the second surface of the thermal paper sheet, wherein the first thermal head and the second thermal head are provided at positions separated from each other along the paper feed direction of the thermal paper sheet, wherein the first thermal head is present on a downstream side of the second thermal head in the paper feed direction, and wherein the first thermal head prints an image corresponding to input printing data on the first surface of the thermal paper sheet, the second thermal head prints an image corresponding to input printing data on the second surface of the thermal paper sheet, and the control section has:

first controlling means for dividing printing data formed of a plurality of bits input from the outside into first printing data and second printing data;

second controlling means for serially reading the first printing data in a direction from a most significant bit to a least significant bit and inputting the read data to the first thermal head at the time of forward printing with respect to the first surface of the thermal paper sheet;

third controlling means for serially reading the first printing data in a direction from the least significant bit to the most significant bit and inputting the read data to the first thermal head at the time of backward printing with respect to the first surface of the thermal paper sheet;

fourth controlling means for serially reading the second printing data in the direction from the most significant bit to the least significant bit and inputting the read data to the second thermal head at the time of forward printing with respect to the second surface of the thermal paper sheet;

fifth controlling means for serially reading the second printing data in the direction from the least significant bit to the most significant bit and inputting the read data to the second thermal head at the time of backward printing with respect to the second surface of the thermal paper sheet; and sixth controlling means for first starting driving of the second thermal head while feeding the thermal paper sheet, and starting driving of the first thermal head when a printing start position based on the first driving corresponds to the first thermal head.

5. A thermal printer, comprising:

a thermal paper sheet which has heat-sensitive layers on both surfaces thereof, and is subjected to paper feeding;

a first thermal head which comes into contact with a first surface of the thermal paper sheet a second thermal head which comes into contact with a second surface of the thermal paper sheet; and a control section which selectively controls forward printing and backward printing of the first thermal head with respect to the first surface of the thermal paper sheet and also selectively controls forward printing and backward printing of the second thermal head with respect to the second surface of the thermal paper sheet; and a first image memory and a second image memory, wherein the first thermal head prints an image corresponding to input printing data on the first surface of the thermal paper sheet, the second thermal head prints an image corresponding to input printing data on the second surface of the thermal paper sheet, and the control section has:

first controlling means for dividing printing data formed of a plurality of bits input from the outside into first printing data and second printing data, storing the first printing data in the first image memory, and storing the second printing data in the second image memory;

second controlling means for serially reading the first printing data in the first image memory in a direction from a most significant bit to a least significant bit and inputting the read data to the first thermal head at the time of forward printing with respect to the first surface of the thermal paper sheet;

third controlling means for serially reading the first printing data in the first image memory in a direction from the least significant bit to the most significant bit and inputting the read data to the first thermal head at the time of backward printing with respect to the first surface of the thermal paper sheet;

fourth controlling means for serially reading the second printing data in the second image memory in the direction from the most significant bit to the least significant bit and inputting the read data to the second thermal head at the time of forward printing with respect to the second surface of the thermal paper sheet; and fifth controlling means for serially reading the second printing data in the second image memory in the direction from the least significant bit to the most significant bit and inputting the read data to the second thermal head at the time of backward printing with respect to the second surface of the thermal paper sheet.

6. A thermal printer, comprising:

a thermal paper sheet which has heat-sensitive layers on both surfaces thereof, and is subjected to paper feeding;

a first thermal head which comes into contact with a first surface of the thermal paper sheet;

a second thermal head which comes into contact with a second surface of the thermal paper sheet;

a control section which selectively controls forward printing and backward printing of the first thermal head with respect to the first surface of the thermal paper sheet and also selectively controls forward printing and backward printing of the second thermal head with respect to the second surface of the thermal paper sheet; and a first image memory and a second image memory, wherein the first thermal head has latching means to which printing data formed of a plurality of bits corresponding to one raster is serially input, and prints an image corresponding to the data in the latching means on the first surface of the thermal paper sheet, the second thermal head has latching means to which printing data formed of a plurality of bits corresponding to one raster is serially input, and prints an image corresponding to the data in the latching means on the second surface of the thermal paper sheet, and the control section has:

first controlling means for dividing printing data formed of a plurality of bits input from the outside into first printing data and second printing data, storing the first printing data in the first image memory, and storing the second printing data in the second image memory;

second controlling means for serially reading the first printing data in the first image memory in a direction from a most significant bit to a least significant bit in accordance with each raster and inputting the read data to the first thermal head at the time of forward printing with respect to the first surface of the thermal paper sheet;

third controlling means for serially reading the first printing data in the first image memory in a direction from the least significant bit to the most significant bit in accordance with each raster and inputting the read data to the first thermal head at the time of backward printing with respect to the first surface of the thermal paper sheet;

fourth controlling means for serially reading the second printing data in the second image memory in the direction from the most significant bit to the least significant bit in accordance with each raster and inputting the read data to the second thermal head at the time of forward printing with respect to the second surface of the thermal paper sheet; and fifth controlling means for serially reading the second printing data in the second image memory in the direction from the least significant bit to the most significant bit in accordance with each raster and inputting the read data to the second thermal head at the time of backward printing with respect to the second surface of the thermal paper sheet.

7. A thermal printer, comprising:

a thermal paper sheet which has heat-sensitive layers on both surfaces thereof, and is subjected to paper feeding;

a first thermal head which comes into contact with a first surface of the thermal paper sheet;

a second thermal head which comes into contact with a second surface of the thermal paper sheet;

a control section which selectively controls forward printing and backward printing of the first thermal head with respect to the first surface of the thermal paper sheet and also selectively controls forward printing and backward printing of the second thermal head with respect to the second surface of the thermal paper sheet; and a first image memory and a second image memory, wherein the first thermal head and the second thermal head are provided at positions separated from each other along the paper feed direction of the thermal paper sheet, wherein the first thermal head is present on a downstream side of the second thermal head in the paper feed direction, and wherein the first thermal head prints an image corresponding to input printing data on the first surface of the thermal paper sheet, the second thermal head prints an image corresponding to input printing data on the second surface of the thermal paper sheet, and the control section has:

first controlling means for dividing printing data formed of a plurality of bits input from the outside into first printing data and second printing data, storing the first printing data in the first image memory, and storing the second printing data in the second image memory;

second controlling means for serially reading the first printing data in the first image memory in a direction from a most significant bit to a least significant bit and inputting the read data to the first thermal head at the time of forward printing with respect to the first surface of the thermal paper sheet;

third controlling means for serially reading the first printing data in the first image memory in a direction from the least significant bit to the most significant bit and inputting the read data to the first thermal head at the time of backward printing with respect to the first surface of the thermal paper sheet;

fourth controlling means for serially reading the second printing data in the second image memory in the direction from the most significant bit to the least significant bit and inputting the read data to the second thermal head at the time of forward printing with respect to the second surface of the thermal paper sheet;

fifth controlling means for serially reading the second printing data in the second image memory in the direction from the least significant bit to the most significant bit and inputting the read data to the second thermal head at the time of backward printing with respect to the second surface of the thermal paper sheet; and sixth controlling means for first starting driving of the second thermal head while feeding the thermal paper sheet, and starting driving of the first thermal head when a printing start position based on the first driving corresponds to the first thermal head.

8. A thermal printer, comprising:

a thermal paper sheet which has heat-sensitive layers on both surfaces thereof, and is subjected to paper feeding;

a first thermal head which comes into contact with a first surface of the thermal paper sheet;

a second thermal head which comes into contact with a second surface of the thermal paper sheet;

a control section which selectively controls forward printing and backward printing of the first thermal head with respect to the first surface of the thermal paper sheet and also selectively controls forward printing and backward printing of the second thermal head with respect to the second surface of the thermal paper sheet; and a first image memory and a second image memory, wherein the first thermal head and the second thermal head are provided at positions separated from each other along the paper feed direction of the thermal paper sheet, wherein the first thermal head is present on a downstream side of the second thermal head in the paper feed direction, and wherein the first thermal head has latching means to which printing data formed of a plurality of bits corresponding to one raster is serially input, and prints an image corresponding to the data in the latching means on the first surface of the thermal paper sheet, the second thermal head has latching means to which printing data formed of a plurality of bits corresponding to one raster is serially input, and prints an image corresponding to the data in the latching means on the second surface of the thermal paper sheet, and the control section has:

first controlling means for dividing printing data formed of a plurality of bits input from the outside into first printing data and second printing data, storing the first printing data in the first image memory, and storing the second printing data in the second image memory;

second controlling means for serially reading the first printing data in the first image memory in a direction from a most significant bit to a least significant bit in accordance with each raster and inputting the read data to the first thermal head at the time of forward printing with respect to the first surface of the thermal paper sheet;

third controlling means for serially reading the first printing data in the first image memory in a direction from the least significant bit to the most significant bit in accordance with each raster and inputting the read data to the first thermal head at the time of backward printing with respect to the first surface of the thermal paper sheet;

fourth controlling means for serially reading the second printing data in the second image memory in a direction from the most significant bit to the least significant bit in accordance with each raster and inputting the read data to the second thermal head at the time of forward printing with respect to the second surface of the thermal paper sheet;

fifth controlling means for serially reading the second printing data in the second image memory in the direction from the least significant bit to the most significant bit in accordance with each raster and inputting the read data to the second thermal head at the time of backward printing with respect to the second surface of the thermal paper sheet; and sixth controlling means for first starting driving of the second thermal head while feeding the thermal paper sheet, and starting driving of the first thermal head when a printing start position based on the first driving corresponds to the first thermal head.

* * * * *

UNITED STATES PATENT AND TRADEMARK OFFICE

CERTIFICATE OF CORRECTION

PATENT NO. : 7,679,632 B2
APPLICATION NO. : 11/681925
DATED : March 16, 2010
INVENTOR(S) : Fumiharu Iwasaki It is certified that error appears in the above-identified patent and that said Letters Patent is hereby corrected as shown below:

The error occurs in the patent on the Title page item (73) Assignee: Toshiba Tec Kabushiki Kaisha, Tokyo (JP)

It should read:

(73) Assignee: Toshiba Tec Kabushiki Kaisha, Tokyo (JP);
NCR Corporation, Dayton, OH (US)

Signed and Sealed this
Twenty-sixth Day of April, 2011

David J. Kappos

David J. Kappos
*Director of the United States Patent and Trademark Office*